United States Patent [19]

Foster

[11] Patent Number: 5,037,513

[45] Date of Patent: Aug. 6, 1991

[54] PRODUCTION OF COATINGS

[75] Inventor: John Foster, Avon, England

[73] Assignee: BAJ Limited, England

[21] Appl. No.: 387,074

[22] Filed: Jul. 31, 1989

[30] Foreign Application Priority Data

Jul. 29, 1988 [GB] United Kingdom ..... 8818069

[51] Int. Cl.[5] ..... C25D 15/00; B05D 1/12

[52] U.S. Cl. ..... 204/16; 427/180

[58] Field of Search ..... 204/16; 427/180, 184, 427/185

[56] References Cited

U.S. PATENT DOCUMENTS

| | | | |
|---|---|---|---|
| 3,830,711 | 8/1974 | Kedward | 204/49 |
| 4,249,998 | 2/1981 | Wilder | 204/16 |
| 4,305,792 | 12/1981 | Kedward | 204/16 |
| 4,789,441 | 12/1988 | Foster | 204/37.1 |

FOREIGN PATENT DOCUMENTS

| | | |
|---|---|---|
| 3003484 | 8/1981 | Fed. Rep. of Germany . |
| WO84/02149 | 6/1984 | PCT Int'l Appl. . |
| 2182055A | 5/1987 | United Kingdom . |

*Primary Examiner*—T. M. Tufariello

[57] ABSTRACT

A process for the production by electrolytic or electroless deposition on a workpiece of a composite coating comprising a metal matrix containing particles is particularly suitable for workpieces of complex geometry or having abrupt changes of shape or sharp edges such as gas turbine blades. The process in which the particles are codeposited with the metal from a solution in which the particles are insoluble comprises inducing circulation generally upwards in one zone and generally downwards in a second zone, locating the workpiece in the second zone and rotating the workpiece about an axis having a horizontal component, the rotational cycle including periods of higher angular velocity and periods of lower angular velocity, preferably a stop/go cycle. Preferably, the workpiece is also rotated about a second axis which is non-parallel with and preferably perpendicular to the first.

4 Claims, 2 Drawing Sheets

PRODUCTION OF COATINGS

This invention relates to apparatus and processes for the production by electrolytic or electroless deposition of composite coatings which consist of a metal matrix containing particles in which processes the particles are co-deposited with the metal from a solution in which the particles are insoluble. The invention is primarily concerned with the deposition of ceramic, cermet or metal particles in coatings in which it is essential to accurately control the composition of the composite produced. Such coatings may be used for various purposes including wear and abrasion resistance, corrosion and oxidation resistance and improvements in coefficient of friction (lubricity) and anti-fretting and anti-galling properties. In certain cases the coatings themselves may constitute the final product so that the process is one of electroforming.

The general process comprises electroplating in a bath containing insoluble particles dispersed in the electrolyte, the particles being codeposited with the metal deposited from the electrolyte. A similar process may be used for electroless deposition but for the most part the description will refer only to electrolytic deposition.

There is described in GB 2 182 055A a process for the electrodeposition of a composite coating comprising a metal matrix containing particles, the particles being codeposited with the metal from a solution in which the particles are insoluble and in which process gas is admitted to the solution at a location to produce circulation in the solution generally upwards in one zone and generally downwards in a second zone and the workpiece is located in the second zone. The two zones can, if necessary be separated by a partition or weir especially if particularly large particles (greater than 50 μm diameter) are to be codeposited since the presence of the partition produces quiescent conditions necessary for the unhindered settling of these particles onto the workpiece where they become embedded in the metal which is being simultaneously plated out.

One particular class of composite coatings which may be produced by the apparatus is that comprising a matrix of Ni, Co or NiCo with particles of CrAlY.

The apparatus described in GB 2182055A produces the settling condition essential to the production of such coating. It has now been appreciated that to produce coatings of uniform composition on components of complex geometry like the turbine blades of aeroengines the codeposition of powder on all surfaces must be maintained at or close to a maximum or saturated level by which is meant that during co-deposition the particles should be present on the surface in quantities and geometrical arrangement which are as close as possible to maximum or natural packing density for the particles concerned; otherwise local changes in current density will give rise to variations in composition. Problems also arise with turbine blades because of their abrupt changes of shape at the leading and trailing edges.

According to one aspect of the present invention, a process for the production by electrolytic or electroless deposition on a workpiece of a composite coating comprising a metal matrix containing the particles, the particles being codeposited with the metal from a solution in which the particles are insoluble, comprises inducing circulation in the solution generally upwards in one zone and generally downwards in a second zone, locating the workpiece in the second zone, and rotating the workpiece about at least one axis having a horizontal component, the rotational cycle including periods of higher angular velocity and periods of lower angular velocity.

For most applications, probably the most satisfactory arrangement of rotation will be alternately stop and go and the following description will mainly be directed to such arrangements but in some cases, for example where the particles are very small (e.g. between one and 10 μm), it may not be necessary to come to a dead stop between each faster period. In certain cases, more complex cycles may be most appropriate so there may be more than two repeating speeds of rotation; likewise the transition from one speed to the other or another may take various forms; indeed there may be no period of constant angular velocity, the speed changing continuously but at varying rates throughout a complete cycle.

The effect of stopping (or slowing down) the rotation is that particles are able to settle and remain on the upwardly facing surface of the workpiece to be trapped by the matrix metal being deposited so that a high volume of particles relative to matrix can be achieved. This is particularly important where the workpiece is irregular, particularly where it has quite abrupt edges or transitions such as the leading and trailing edges of aerofoil sections.

The pattern of rotation may be adapted to the workpiece being coated so that particular bands (extending parallel with the axis of rotation) of the workpiece surface face upwardly longer than others but for most applications this is unnecessary provided that all the bands have a sufficient dwell time facing upwards.

The angular movement of the workpiece in the faster periods (and in the slower periods if rotation is not then completely stopped) may vary considerably. For example, a stationary period may be followed by a rapid rotation through only a few degrees before the workpiece becomes stationary again, the successive upwardly facing zones thus overlapping one another. However, it is preferred for the workpiece to rotate through a larger angle, possibly more than 360° and possibly several complete revolutions between each stationary period. Provided that the number of stop and start periods in a complete plating operation is large, a regular coating will be achieved, although it is desirable that the arrangement is such that the cycle is not repeated identically for each revolution which could produce an uneven deposit around the axis of rotation. Thus, in a possible example, the workpiece is rotated at between one third and one half revolutions per minute with each stop period being of approximately ten seconds and each go period being of approximately three seconds duration. This is suitable for small particles in the 1 to 10 μm range when plating at 10 mA/cm$^2$. However much larger stationary periods may be desirable for larger particles of or greater than 100 μm.

Where, the workpiece is of irregular or complex shape adequate inclusions of particles may not be achieved on certain areas, even by use of the above described techniques. For example, the workpiece may have two surfaces which, when considered in a section containing the longitudinal axis are at right angles to one another or form a re-entrant. Therefore, particles may run down one of the surfaces even when settling satisfactorily on the other.

According to a second aspect of the present invention which may be used in combination with or independently of the first aspect, a process for the production by electrolytic or electroless deposition on a workpiece of a composite coating comprising a metal matrix containing particles, the particles being codeposited with the metal from a solution in which the particles are insoluble, comprises inducing circulation in the solution generally upwards in one zone and generally downwards in a second zone, locating the workpiece in the second zone and rotating the workpiece about a plurality of axes. By rotating the workpiece about two or more axes, it can be arranged that all surfaces to be coated face sufficiently close to vertically upwards for a sufficient proportion of the total plating time for them all to be satisfactorily coated.

The invention, according to either of its aspects, may be applied to the apparatus and methods described with reference to drawings in GB 2 182 055A and may be used, for example, to produce coatings comprising a matrix of Ni, Co or NiCo with particles of CrAlY. More detailed information concerning such coatings may be obtained from GB 2 167 466B.

The invention may be performed in various ways but one form of apparatus and a method of coating using the apparatus will now be described by way of example with reference to the accompanying diagrammatic drawings, in which.

Figure 1:
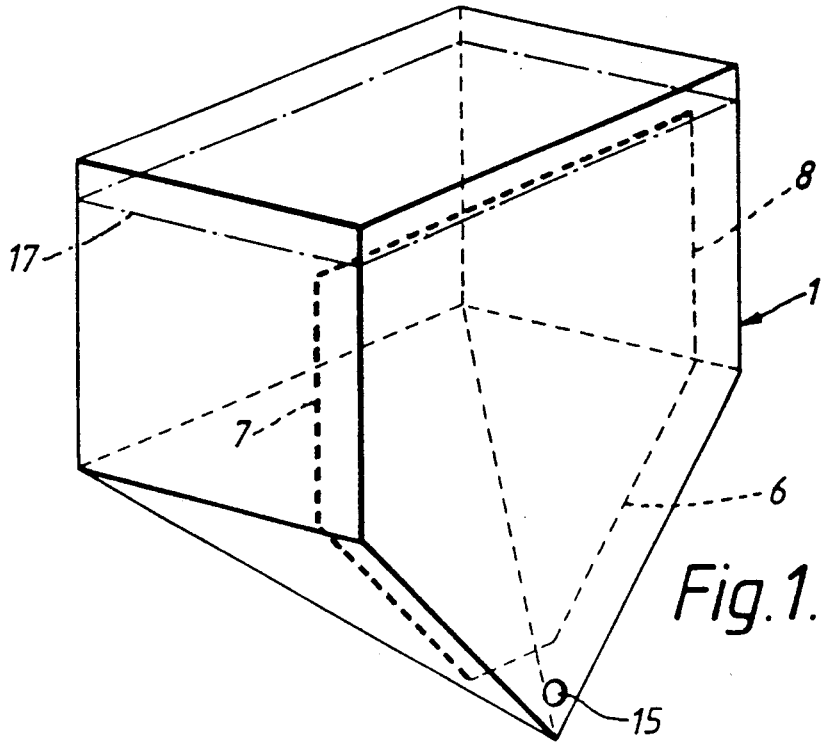
FIG. 1 is a perspective view of the apparatus.

The apparatus shown in the drawings, comprises a vessel or container 1 having a parallelepiped shaped upper portion 2 and a downwardly tapering lower portion 3 in the form of an inverted pyramid which is skewed so that one side face 4 forms a continuation of one side face 5 of the upper portion.

The vessel 1 contains a partition 6 which lies in a vertical plane parallel to the side faces 4 and 5 of the vessel and makes contact at its side edges 7 and 8 with the adjacent vertical and sloping faces of the vessel. The partition thus divides the vessel into a larger working zone 9 and a smaller return zone 11. At its bottom, the partition 6 terminates at a horizontal edge 12 above the bottom of the vessel to afford an interconnection 13 between the working zone 9 and the return zone 11. At its top, the partition 6 terminates at a horizontal edge 14 below the top edges of the vessel 1.

At the bottom of the return zone 11 there is an air inlet 15 which is connected to an air pump (not shown). Mounted in the working zone 9 is a jig 21 to which the workpiece to be coated are mounted, the jig 21 being arranged to move the workpieces within the vessel in a manner to be described in greater detail below.

When the apparatus is to be used for electrolytic plating, conductors are provided to apply a voltage to the workpiece mounted on the jig 21 relative to an anode which is suspended in the working zone.

To use the apparatus, to codeposit a coating on the workpieces, the workpieces are mounted on the jig 21 which is positioned in the vessel as shown. Before or after the positioning of the jig, the vessel is filled to a level 17 above the top edge 14 of the partition 6 with a plating solution containing particles to be co-deposited. Air is admitted to the inlet 15 and this rises up the return zone 11, raising solution and entrained particles. At the top of the return zone, the air escapes and the solution and particles flow over the broad crested weir formed by the top edge 14 of the partition and flow down past the workpieces on the jig 21. At the bottom of the working zone 9, the particles tend to settle and slide down the inclined sides of the vessel towards the interconnection 13 where they are again entrained in the solution and carried round again.

As the downwardly travelling particles in the working zone 9 encounter the workpiece, they tend to settle on the workpiece where they become embedded in the metal which is being simultaneously plated out.

Figure 2:
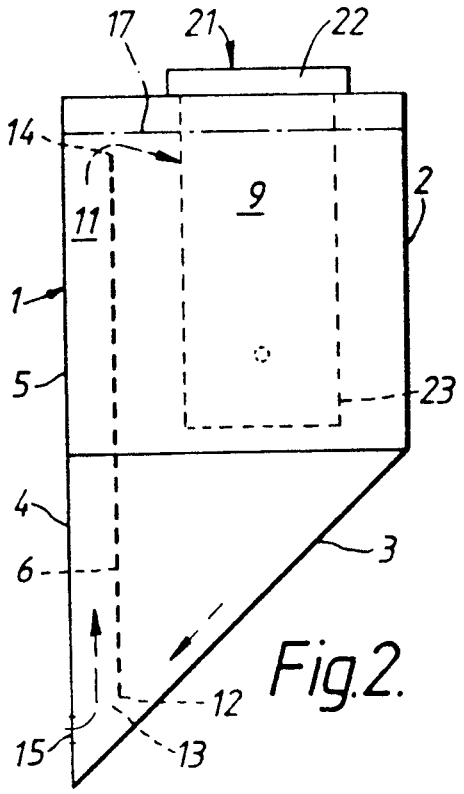
FIG. 2 is a side elevation of the apparatus.
Figure 3:
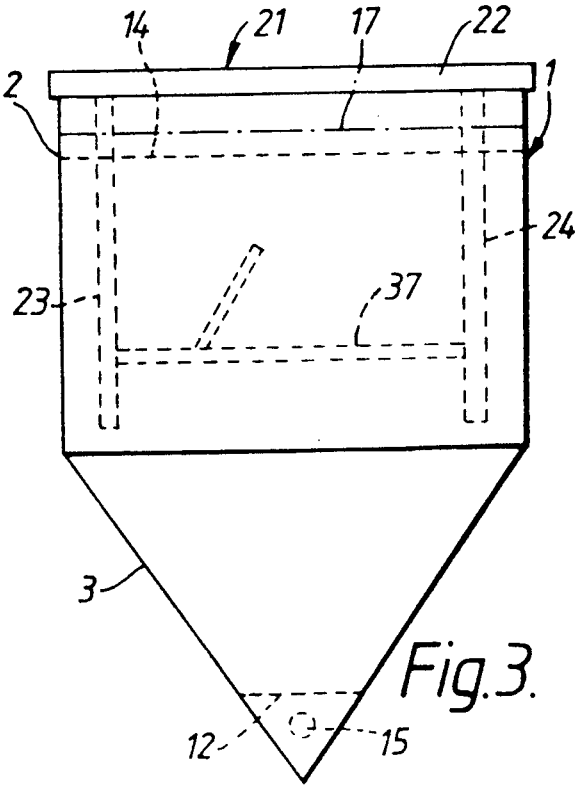
FIG. 3 is a front elevation of the apparatus.
Figure 4:
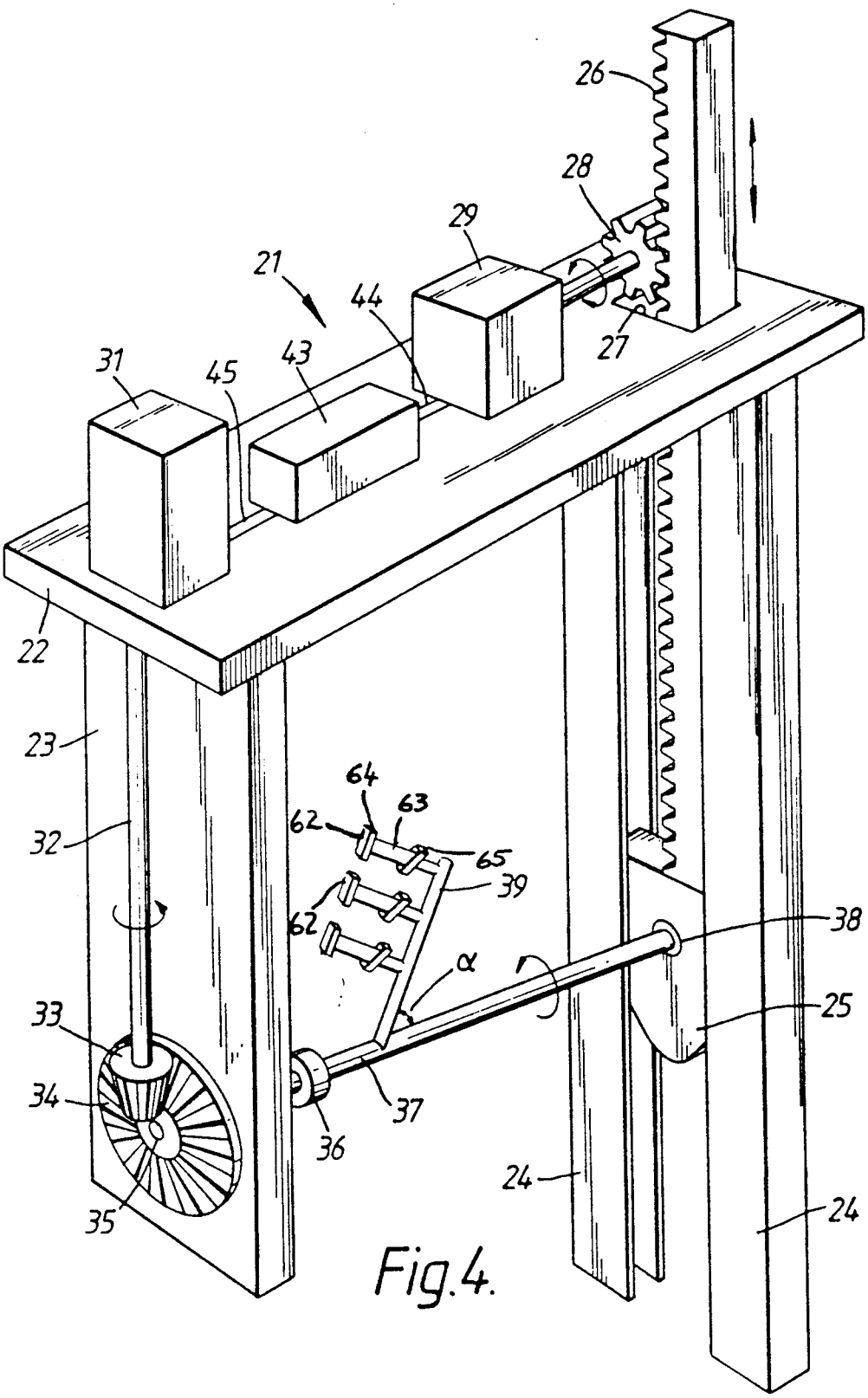
FIG. 4 is a perspective view of the jig on which the articles to be plated are suspended.

The workpieces to be coated are mounted on a jig 21 shown in FIG. 4 which is suspended in the vessel 1. The jig is shown in simplified form in FIGS. 2 and 3 but omitted from FIG. 1 for reasons of clarity. The jig 21 comprises a deck 22 which fits over the top of the vessel 1, a depending pillar 23 towards one end and a pair of depending guides 24 at the other end. The guides 24 have facing guideways in which slides a cross-head 25 carrying a vertical rack 26 which passes upwards through a hole 27 in the deck 22 and meshes with a pinion 28 driven by a reversible electric motor 29. The deck 22 supports a second electric motor 31 which drives a vertical shaft 32 carrying a bevel pinion 33 which engages a crown-wheel 34 fixed to one end of a spindle 35 mounted in the pillar 23. The other end of the spindle 35 is connected by a universal joint 36 to one end of a shaft 37 the other end of which is carried by a spherical bearing 38 in the cross-head 25.

The shaft 37 carries a plurality of spurs which are rigidly attached thereto, only one spur 39 being shown in FIG. 4. The spur 39 extends in a plane containing the axis of the shaft 37 with the longitudinal axis of the spur making an angle $\alpha$ with the axis of the shaft 37. Mounted on the spur 39 and spaced therealong are three gas turbine blades 42 to be coated, with the longitudinal axes of the blades extending in the said plane and perpendicular to the longitudinal axis of the spur 39 so that the longitudinal axes of the blades make angles of $(90-\alpha)^\circ$ to the axis of the shaft 37.

An electronic motor controller 43 is mounted on the deck 22 and is connected by lines 44 and 45 to the motors 29 and 31. The controller 43 is designed to drive the motor 29 in one direction only but with a stop so as to rotate the shaft 37 about a nominally horizontal axis (the x-axis). The controller 43 is designed to drive the motor 31 alternately in opposite directions to reciprocate the cross-head 25 and so superimpose on the rotation about the x-axis an oscillatory rotation about a rotating axis in the universal joint 36 (the y-axis).

The angle $\alpha$ and the parameters of the cycles executed by the motors 29 and 31 are selected to suit the workpiece being coated so as to ensure that all surfaces to be coated spend sufficient time facing generally upwardly to receive an adequate loading of descending particles to be incorporated in the plated metal as it is deposited.

One particular class of composite coatings which may be produced by the apparatus described is that comprising a matrix of Ni, Co or NiCo with particles of CrAlY. It has been found that good quality coatings containing up to 30% by weight of particles can be produced using only 1 gram per liter of particles in the solution.

One particular example of a coating and the method of production thereof will now be described by way of example.

EXAMPLE

The coating is to be produced on a gas turbine blade 62 having an aerofoil section 63 with a root portion 64 at one end and a shroud portion 65 at the other end, the platforms of the root and shroud both extending at angles of approximately 70° to the axis of the aerofoil portion and the root portion and the shroud portion having end faces which extend at respectively 30° and 40° to the circumference of the ring of which the blade forms part. For blades of this geometry the angle $\alpha$ is 70°.

It is intended to produce on the aerofoil and platform portions of the blade a coating containing 18.32 weight percent Cr, 8.25 weight percent Al, 0.457 weight percent Y and the remainder cobalt. To produce such a coating the bath is filled with a cobalt plating solution comprising 400 grams per liter of $CoSO_4.7H_2O$, 15 grams per liter ~~of~~ NaCl and 20 grams per liter of boric acid $H_3BO_3$. The bath is maintained at a pH of 4.5 and a temperature of 45° C. The bath is loaded with powder to a concentration of 70 grams per liter, the powder having a size distribution of 5 to 15 micrometers and being composed of 67.8 weight percent chromium, 30.1 weight percent aluminium and 1.7 weight percent yttrium.

Prior to coating the parts of the root and shroud portions which are not be plated are given a wax mask and the remaining surfaces are given the conventional preparation treatments appropriate to cobalt plating.

The blade is fixed to the jig with its axis (see FIG. 4) at 20° to the x axis of the jig which is horizontal (see FIG. 5). During plating the x axis of the jig is oscillated plus and minus 25° about the y axis which is perpendicular to the x axis with a cycle time of 3 minutes. Simultaneously, the jig is rotated about the x axis unidirectionally and through 360° with a cycle time of 10 minutes for a complete revolution. However the rotation about the x axis is intermittent with 10 second stop periods being interspersed with 3 second go periods.

Plating is carried out with a current density of 0.3 amps per square decimeter for a period of 24 hours to produce a coating thickness of between 50 and 125 micrometers.

A coating of excellent qualities is produced covering the aerofoil portion and the root and shroud platforms and having a weight fraction of incorporated powder of 0.27. After removal of the coated blades from the jig, the masking is removed and the blades are heat treated to effect some interdiffusion between the matrix and the particles and to effect some degree of alloying.

I claim:

1. A process for the production by electrolytic or electroless deposition on a workpiece of a composite coating comprising a metal matrix containing particles, the particles being codeposited with the metal from a solution in which the particles are insoluble, comprising inducing circulation in the solution generally upwards in one zone and generally downwards in a second zone, locating the workpiece in the second zone, and rotating the workpiece about an axis having a horizontal component, the rotational cycle including periods of higher angular velocity and periods of lower angular velocity.

2. A process as claimed in claim 1 in which the rotation is alternately stop and go.

3. A process as claimed in claim 1 in which the workpiece is also rotated about a second axis which is non-parallel with the first.

4. A process for the production by electrolytic or electroless deposition on a workpiece of a composite coating comprising a metal matrix containing particles, the particles being codeposited with the metal from a solution in which the particles are insoluble, comprising inducing circulation in the solution generally upwards in one zone and generally downwards in a second zone, locating the workpiece in the second zone and rotating the workpiece about a first axis having a horizontal component, and rotating the workpiece about a second axis which is non-parallel with the first.

* * * * *